US005876226A

United States Patent [19]

Tsukakoshi et al.

[11] Patent Number: 5,876,226

[45] Date of Patent: Mar. 2, 1999

[54] CONNECTOR WITH CAM MEMBER

[75] Inventors: Masao Tsukakoshi, Machida; Kazuhisa Betsui, Yokohama, both of Japan

[73] Assignee: The Whitaker Corporation, Wilmington, Del.

[21] Appl. No.: 817,371

[22] PCT Filed: Aug. 30, 1995

[86] PCT No.: PCT/US95/10976

§ 371 Date: Mar. 27, 1997

§ 102(e) Date: Mar. 27, 1997

[87] PCT Pub. No.: WO96/12325

PCT Pub. Date: Apr. 25, 1996

[30] Foreign Application Priority Data

Oct. 14, 1994 [JP] Japan ..... 6-248935

[51] Int. Cl.[6] ..... H01R 13/62

[52] U.S. Cl. ..... 439/157; 439/347

[58] Field of Search ..... 439/157, 347, 439/259, 266, 152, 160, 310, 352

[56] References Cited

U.S. PATENT DOCUMENTS 5,236,373 8/1993 Kennedy ..... 439/347
5,326,274 7/1994 Pfaff et al. ..... 439/157
5,575,676 11/1996 Tsukakoshi et al. ..... 439/157
5,618,194 4/1997 Maue et al. ..... 439/157
5,618,195 4/1997 Cappe ..... 439/157
5,637,009 6/1997 Tsuji et al. ..... 439/347
5,681,184 10/1997 Pamart et al. ..... 439/347

*Primary Examiner*—Paula Bradley
*Assistant Examiner*—Tho Dac Ta

[57] ABSTRACT

To enable a worker to be able to quickly and correctly verify that a slide-type cam member has moved into a closed position, making it possible for a housing of a mating connector to be moved into a completely engaged position, a resilient latch 40 member, which extends toward a housing 12 from an upper end of a side wall section 33 of a cam member 30, is located on the cam member 30. A latch section 50, which has an aperture 54 that receives a protrusion 42 of the latch member 40, is located on an upper part of the housing 12. As the cam member 30 is moved from a first position to a closed position, the latch member 40 is depressed downward as a result of the protrusion 42 moving along a second surface 55 of the latch section 50. When the cam member 30 has moved into the closed position, the protrusion 42 is received by the aperture 54 and, by virtue of the interrelationship, the latch member 40 resiles to its original shape. When this occurs, a first surface 41 of the latch member 40 is brought into contact with the second surface 55 of the latch section 50, thereby producing an audible sound signifying complete engagement between matable connectors.

7 Claims, 6 Drawing Sheets

CONNECTOR WITH CAM MEMBER

FIELD OF INVENTION

This invention relates to electrical connectors and a connector to which a cam member is attached. In particular, it relates to connectors with cam members whose housings can be completely engaged by little force with the housing of a mating connector by manipulating the slide-type cam member.

BACKGROUND OF THE INVENTION

This sort of connector with a slide-type cam member is configured like the connectors disclosed in Japanese UM Publication No. 6-11275 and No. 6-54255, for example, so that the housing can be completely engaged with the housing of a mating connector by sliding or moving the cam member from a first and open position, from which the cam member can be connected with the housing of the mating connector that is in a temporarily engaged position, to the closed position, whereby the cam member is moved into a position at which it completely engages with the housing of the mating connector.

In order to correctly carry out the task of connection with a mating connector, it is preferable that the worker is able to quickly verify that the cam member has moved completely to the closed position. However, with the conventional connectors that are provided with a cam member, it has been difficult for workers to confirm whether or not the cam member has completely moved to the closed position. Consequently, performing the connection has been difficult, and there was also a high probability that the connection ended without the cam member sliding to the closed or connected position. In particular, there have been cases, depending on the technical field, such that the worker groped around to make the two connectors connect and this made it all the more difficult for the worker to verify that the cam member had moved to the completely closed position.

In view of the situations described above, the object of this invention is to provide a connector with a cam member that enables the worker to quickly and correctly verify that the slide-type cam member was moved to the completely closed or connected position and that the connection with the mating connector was properly made.

An electrical connector assembly is disclosed in U.S. Pat. No. 4,596,771 and comprises first and second connector housings and a camming slide for mating and unmating the housings. The first housing has flanges extending from the mating face thereof and has slots in the flanges which receive cam followers on the cam slide. The second housing has cam tracks in its sidewalls which also receive the cam follows. The camming slide has a web which is spaced from the rear face of the second housing and arms which extend from the web across the sidewalls of the second housing and which overlap the flanges on the first housing. The cam followers project from the internal surfaces of the arms and extend through the slots and are dimensioned to be received in the camming slots on the second housing. Recessed surfaces are located an the inner surfaces of the arms and projections are provided at left hand ends of the recesses which ride over projections on the flanges thereby retaining the camming slide in position when the housings are at a mated condition.

An electrical connector housing assembly is also disclosed in U.S. Pat. No. 5,244,400 which comprises a male housing, a female housing in which the male housing is movably fitted, a cam member is movably fitted on the female housing so that the cam member can be moved relative thereto in order to fasten both housings together, and a detecting member being provided on the cam member and the female housing for detecting whether both housings are completed mated to each other.

In order to achieve the aforementioned objective, a connector assembly with a cam member of the present invention comprises connectors whose housings can be completely engaged by sliding a slide-type cam member attached to one of the housings from a first position to a closed position, wherein the cam member is provided with a resilient latch, which is positioned outsides of the housing. When the cam member has been moved to the closed position, the latch member has a first surface that extends in a direction nearly parallel to the direction in which the cam member slides and is resiliently deformable in a direction nearly perpendicular to the direction of sliding, The housing is also provided with a latch section, which has a second surface that extends in a direction nearly parallel to the direction of sliding. The resilient latch member is provided with a protrusion, and it bends and deforms in a direction nearly perpendicular to the resilient latch member as it engages against the latch section when the cam member is slid from the first position to the closed position; the latch section is provided with a hole or aperture that receives the protrusion when the cam member is moved to the closed position, thereby causing the resilient latch member to be restored to its original state. The second surface of the latch section is provided at a position when it will produce an audible sound when it comes into contact with the first surface of the resilient latch member when it has been restored to its original state.

During the use of a connector with the cam member of this invention, when the slide-type cam member is moved from the first position to the closed position, the first surface of the resilient latch and the second surface of the latch section will come into contact with each other and make an audible sound when the resilient latch member is restored to its original state. Consequently, the worker who performs the task of connecting the connector with a mating connector will be able to quickly and accurately verify that the cam member has moved to the closed position by listening to hear whether or not the audible sound was produced. Due to the resilient latch member and latch section being provided in positions on the outside of the housings, the audible sound propagates well, and the worker can easily verify that the audible sound was produced. In addition, because a vibration is transmitted in the housings and cam member when the first surface makes contact with the second surface of the resilient latch member of the latch section, the worker can verify that the cam member has moved to the closed position by feeling the vibration with his hand, along with hearing the audible sound.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
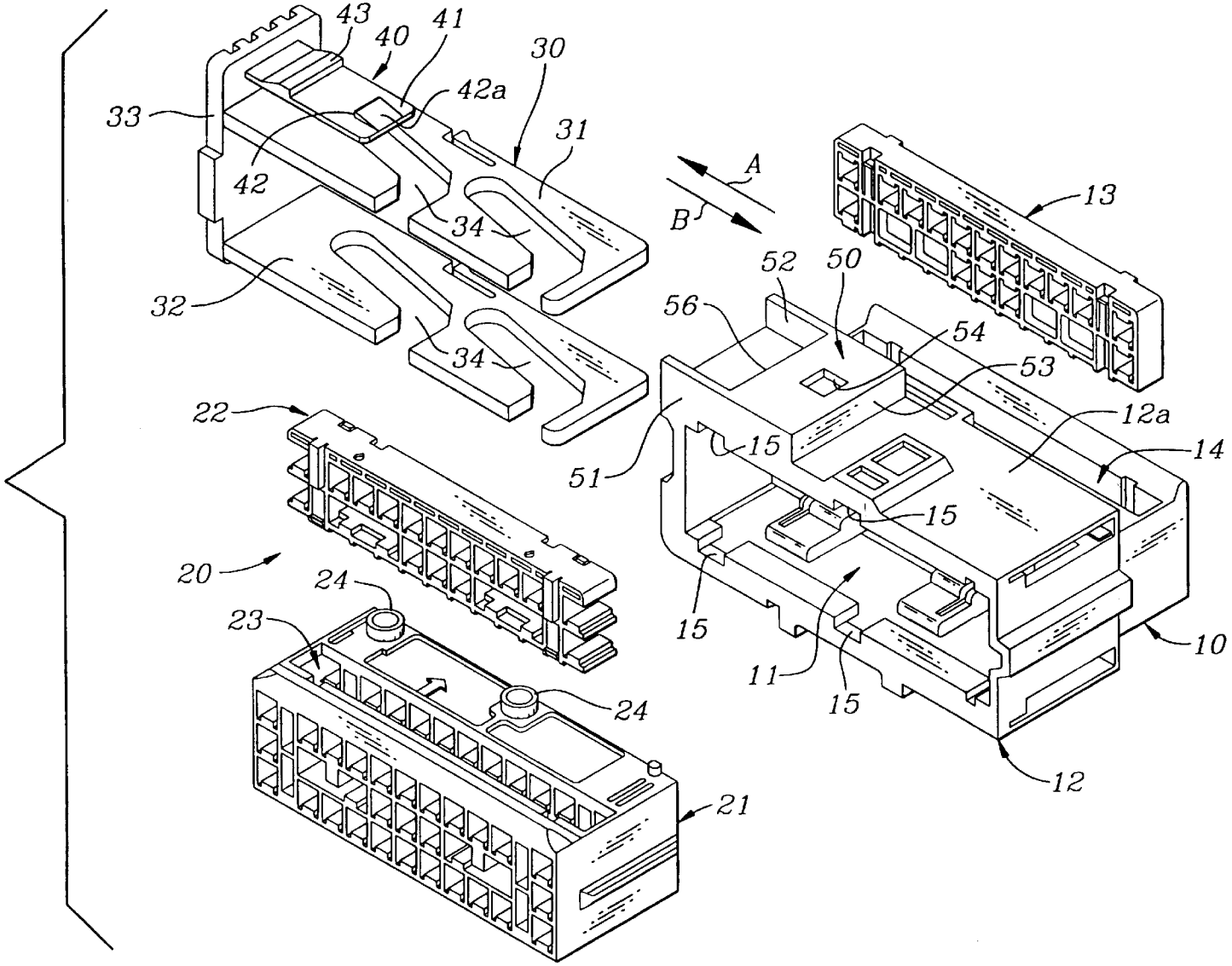
FIG. 1 is an exploded perspective view showing an embodiment of a disassembled connector with cam member and a mating connector.

Connector 10 shown in FIG. 1 is provided with a female-type housing 12 that has a recessed section 11 into which the male-type housing 21 of mating connector 20 is inserted. On the upper sides of housing 12 and housing 21 of the mating connector 20, insertion openings 14 and 23 are located. The insertion openings 14 and 23 are for insertion of double lock members 13 and 22, which prevent backing out of the terminals (not shown in the drawing) that are inserted into the housings 12 and 21.

A sliding cam member 30, which can slide along the housing 12 (directions shown by arrows A and B in the drawing) within the recessed section 11, is attached to the housing 12. This cam member 30 has an upper wall section 31 and a lower wall section 32 that extend parallel from a side wall section 33 that joins the upper and lower wall sections. Two cam grooves 34 are located in both the upper wall section 31 and lower wall section 32. The depictions of the cam grooves 34 are simplified.

On the other hand, two follower pins 24, which go into the cam grooves 34 of the cam member 30, are located on both the top and bottom of the front edge of the housing 21 of the mating connector 20 (the bottom part is omitted from the drawing). Then, two guide grooves 15, which are for guiding the follower pins 24 within the cam grooves 34 of the cam member 30, are located at both the top and bottom of the front edge of the housing 12.

Figure 2:
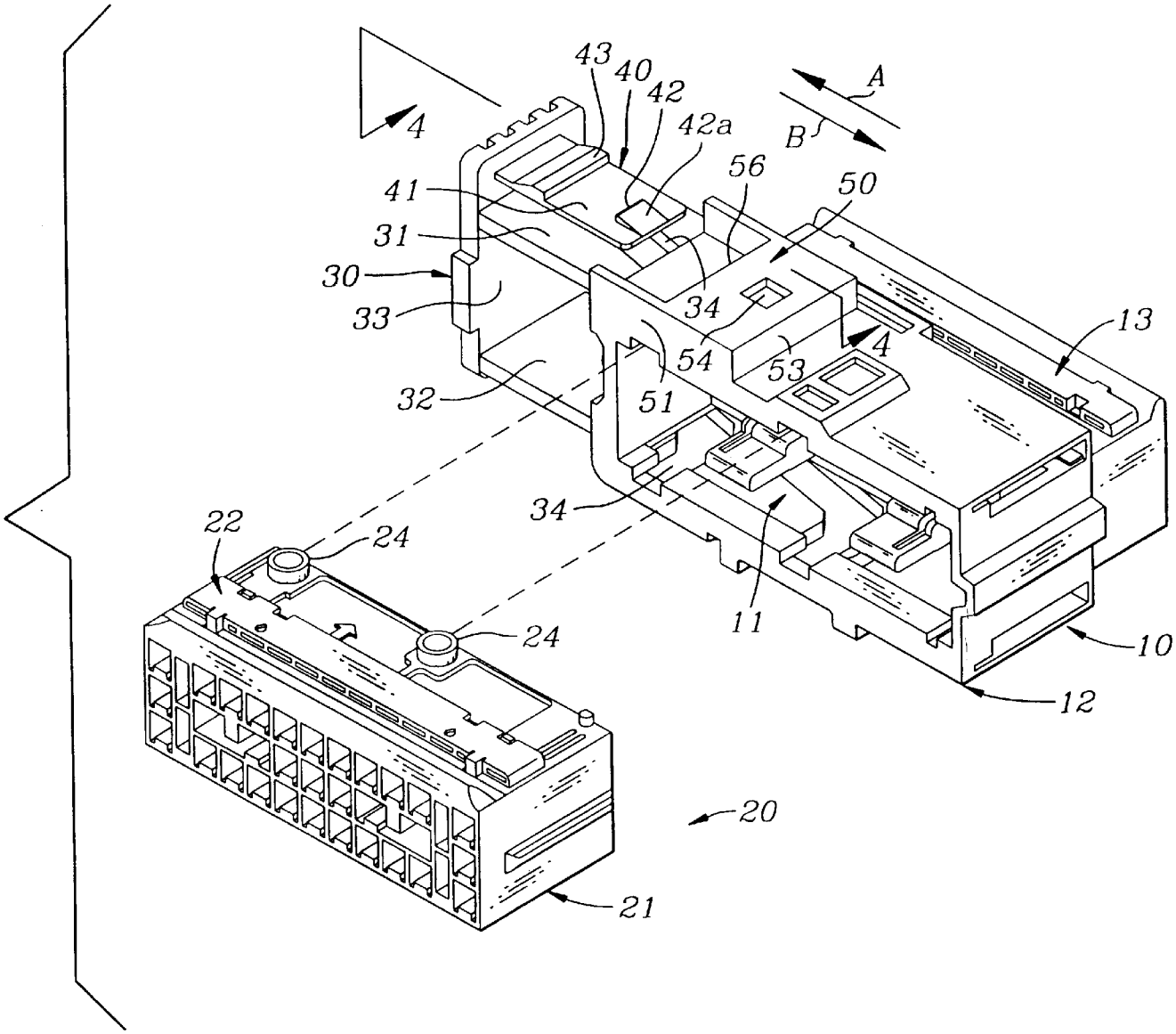
FIG. 2 is a view similar to FIG. 1 showing the assembled connectors and the connector with the cam member in a first position.
Figure 3:
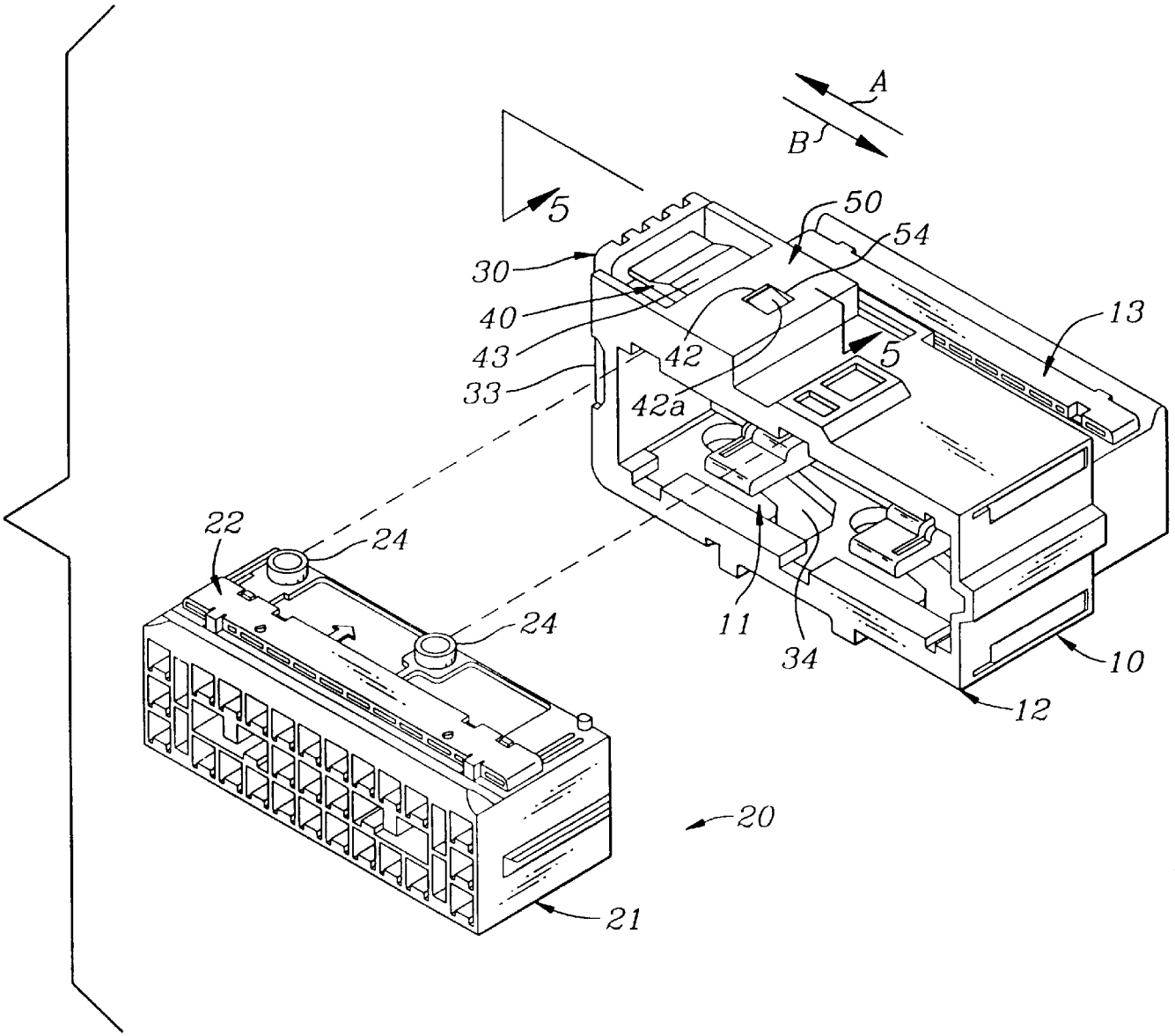
FIG. 3 is a view similar to FIG. 2 showing the connector with the cam member in the closed position.
Figure 4:
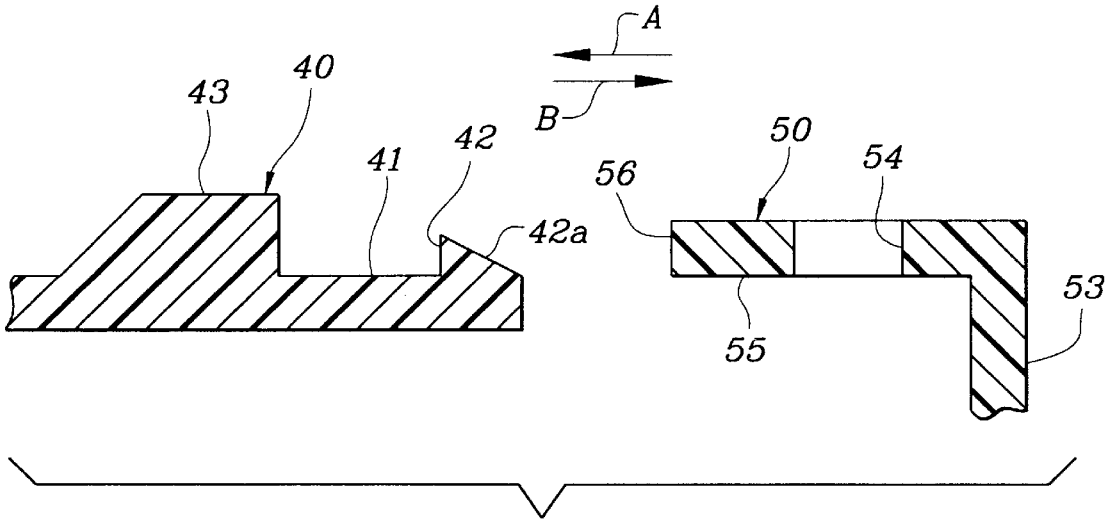
FIG. 4 is a cross-sectional view taken along line 4—4 of FIG. 2.
Figure 5:
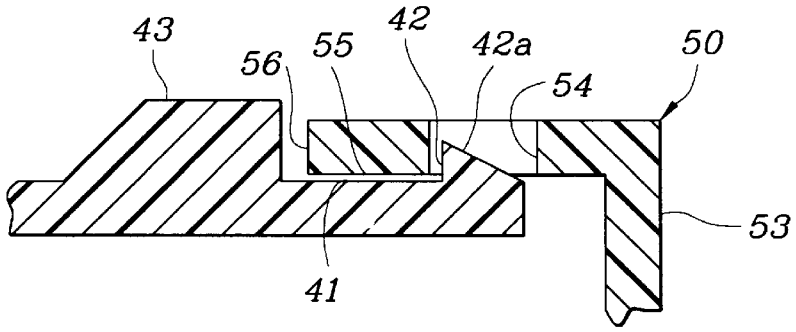
FIG. 5 is a cross-sectional view taken along 5—5 of FIG. 3.

FIGS. 2 and 3 depict the action of the cam member 30. FIG. 2 shows the cam member when it is in a first position; FIG. 3 shows the cam member when it is moved into the closed position. FIG. 4 is a cross-sectional view showing the main parts of the cam member 30 at the first position; FIG. 5 is a cross-sectional view showing the cam member at the closed position. The sliding cam member 30 is attached to the housing 12 in such a way that the cam member can slide in the A and B directions shown in the drawings, i.e. between the first position shown in FIG. 2 and the closed position as shown in FIG. 3. When the cam member 30 is in the first position shown in FIG. 2, if the housing 21 of the mating connector 20 is inserted up to a temporarily engaged position within the recessed section 11 of the housing 12, the follower pins 24 of the housing 21 can go into the cam grooves 34 of the cam member 30, and by sliding the cam member 30 from there to the closed position shown in FIG. 3, the housing 21, which was in a temporarily engaged position, can be completely engaged with little force with the housing 12 by the cam action between the cam grooves 34 and the follower pins 24. Incidentally, because the shapes of the cam grooves 34 in FIGS. 2 and 3 are simplified, the drawings do not show the cam grooves 34 and follower pins 24 as they go together.

Latch member 40, which extends in the B direction from the upper end of the side wall section 33 and extends from a position above the upper wall section 31 in a direction nearly parallel to the upper wall section 31, is located on the cam member 30, as shown clearly in 35 FIG. 1, and forms a unit with the cam member 30. Latch member 40 has a first surface 41 that faces upwards, a protrusion 42, which has a bevelled surface 42*a* formed on the edge of that first surface 41, and a protrusion 43 formed at the back of the first surface 41.

On the other hand, a plate-shaped latch section 50 that extends in a direction nearly parallel to the upper surface 12*a* of the housing 12 is located on the upper part of the housing 12 and forms a unit with the housing 12. This latch section 50 is joined to the housing 12 on three of the four surrounding sides by the front wall 51, which extends upwards from the front edge of the housing 12; the back wall 52, which faces to front wall 51; and the joining wall 53, which joins the front wall 51 and the back wall 52. A hole or aperture 54 is located in the central part of the latch section 50 and receives the protrusion 42 on the latch member 40 of the cam member 30. In addition, a second surface 55 is located on the latch section 50. Second surface 55 comes into contact with the first surface 41 of the latch member 40 and makes an audible sound when the protrusion 42 of the latch member 40 and the aperture 54 are engaged as shown in FIG. 5.

Next, the action of the latch member 40 of the cam member 30 with the latch section 50 of the housing 12 will be explained. When the cam member 30 is slid in the B direction from the first position shown in FIG. 2, the bevelled surface 42*a* of the protrusion 42 of the latch member 40 engages with the edge 56 of the latch section 50. In addition, when the cam member 30 commences its slide movement, as the edge 56 of the latch section 50 makes contact with the bevelled surface 42*a* of the protrusion 42, the latch member 40 is resiliently depressed and the protrusion 42 is driven along the second surface 55 until the protrusion 42 is received in aperture 54, which means the cam member 30 has moved to the closed position shown in FIGS. 3 and 5. When that connection is made, the first surface 41 of the latch member is forcefully brought into contact with the second surface 55 of the latch section 50.

When the first surface 41 of the latch member 40 makes contact with the second surface 55 of the latch section 50, an audible sound is generated. A worker can then quickly and reliably confirm by such sound that the cam member 30 has moved to the closed position and that the connectors 10 and 20 are completely connected. Incidentally, the cam member 30 that has moved into the closed position can be slid in the A direction to return it back to the first position by pushing the protrusion 43 of latch member 40 down thereby bending the latch member 40 downward and undoing the connection between the protrusion 41 of the latch member 40 and the aperture 54 of the latch section 50; and with that movement the two completely engaged connectors 10 and 20 can be disconnected.

Figure 7:
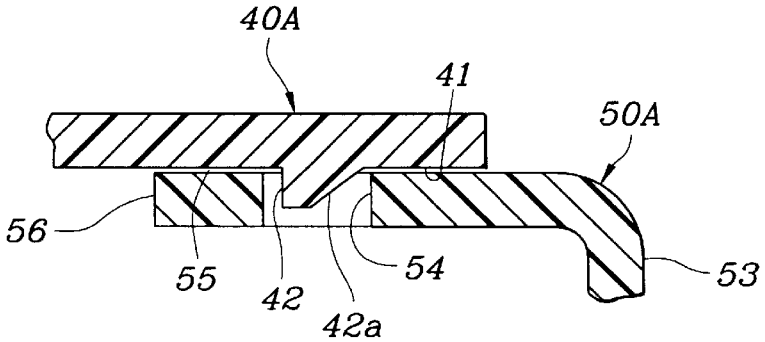
FIG. 7 is a cross-sectional view showing the resilient member the contact section of the connector of FIG. 6 when they are connected together.
Figure 6:
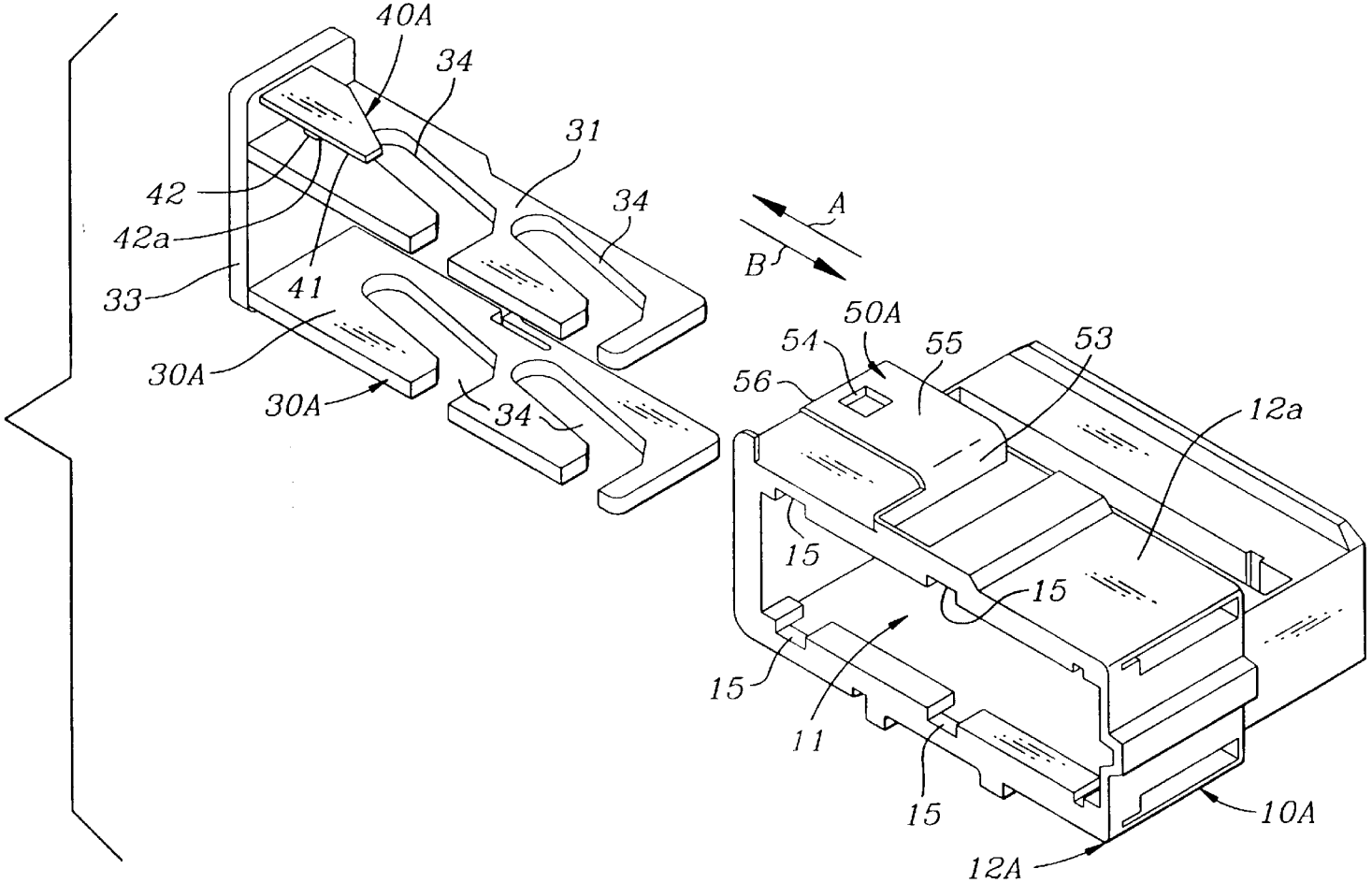
FIG. 6 is an exploded perspective view of another embodiment of a disassembled connector with cam member.

Next, another embodiment of the invention will be explained as shown in FIGS. 6 and 7. The only differences between connector 10A of this embodiment and the aforementioned first embodiment are the configuration of the latch member 40A of the cam member 30A, and the latch section 50A of the housing 12A. The latch member 40A of the cam member 30A extends in the B direction from the upper edge of the side wall section 33 of the cam member 30A and extends in a position above the upper wall section 31 in a direction nearly parallel to the upper wall section 31. The latch member 40A has its first surface 41 on the side facing the upper wall section 31; a protrusion 42 that has a bevelled surface 42*a* and protrudes downward is formed on the first surface 41.

On the other hand, only the back end of the latch section 50A of the housing 12A is joined to the upper 35 surface 12*a* of the housing 12A through a joining wall 53. Like the latch member 40A of the cam member 30A, the latch section 50A of-the housing 12A is configured so that it can resiliently move in such a way that it will bend a great deal up or down, a point that differs from the first embodiment. As in the first embodiment, an aperture 54 is formed in the central part of the latch section 50A, and aperture 54 receives the protrusion 42 of the latch member 40A to connect with it, but the second surface 55, which makes an audible sound when contact is made with the first surface 41 of latch member 40A, is formed on the upper side of the latch section 50A.

In the first embodiment, the latch member 40 enters the latch section 50 from the lower side, and protrusion 42 engages the aperture 54 from the lower side. In this embodiment, however, the latch member 40A overlaps the upper side of the latch section 50A, and protrusion 42 is formed in such a way that it engages the aperture 54 from the upper side. Incidentally, a detailed explanation of the functions of the latch member 40A and the latch section 50A are omitted because they are the same as in the first embodiment.

In this second embodiment, because the latch section 50A is configured so that it is resilient, there is an advantage in that the audible sound is easily produced when the first surface 41 of the latch member 40A and the second surface 55 of the latch section 50A come into contact with each other. In addition, when releasing the connection between the latch member 40A and the latch section 50A, the protrusion 42 of the latch member 40A may be detached from the aperture 54 by pressing down on the latch member 40A from above and bending both the latch member 40A and the latch section 50A downward.

Figure 8:
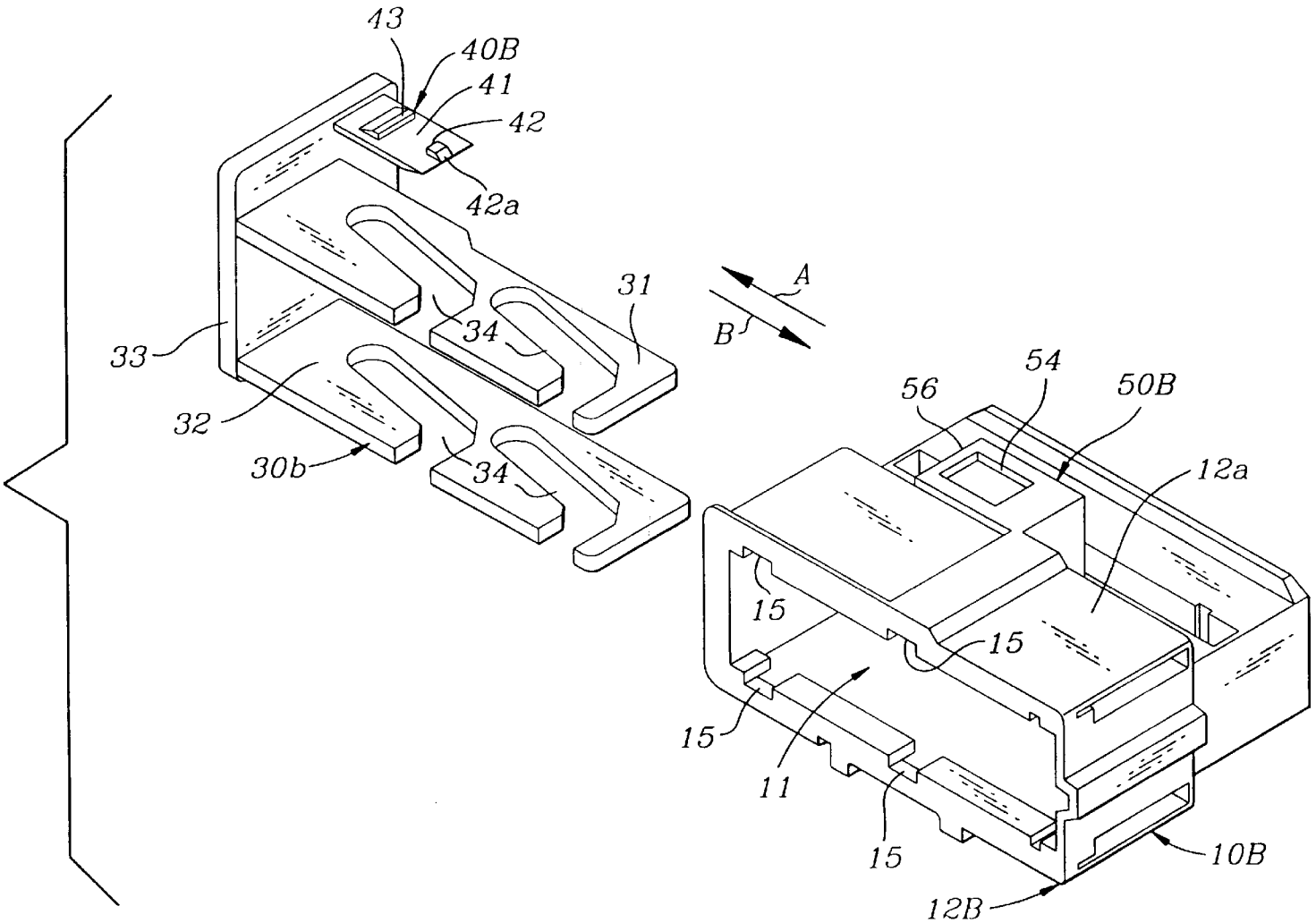
FIG. 8 is a view similar to FIG. 6 showing a further embodiment of a disassembled connector with cam member.

Next, a further embodiment of the inventor will be explained as shown in FIG. 8.

In connector 10B of this embodiment, the latch member 40B of the cam member 30B is formed at a position that is shifted toward the rear of the upper wall section 31 of the cam member 30B, and the latch section 50B of the housing 12B is formed at a position that is shifted toward the rear of the upper surface 12*a* of the housing 12B so that it will accommodate the latch member 40B. Those are the only points of difference from the first embodiment. The functions of the latch member 40B and the latch section 50B are the same as in the first embodiment, therefore a detailed explanation is omitted.

Embodiments of this invention have been explained hereinabove; however, this connector with cam member invention is not limited to the disclosed structures of such embodiments, and various modifications thereof can be made.

For example, in each of the disclosed embodiments, the protrusion is formed on the latch member, and the aperture is formed on the latch section; however, the aperture may also be formed on the latch member and the protrusion on the latch section. Incidentally, the aperture may also be a recessed cavity.

In addition, in contrast to the structures of the aforementioned embodiments, the resilient latch member may also be formed on the housing and the latch section on the cam member.

We claim:

1. An electrical connector housing assembly of the type comprising first and second connector housings (10, 20), the first connector housing (10) having a recess section (11) for receiving the second connector housing (20) therein, a cam member (30) slidably mounted on said first connector housing (10) for movement there along from a first position to a closed position, said cam member (30) having cam grooves (34) therein for receiving follower pins (24) on the second connector housing (20) when the cam member (30) is at the first position and the follower pins (24) move along the cam grooves (34) as the cam member (30) is moved to the closed position thereby moving the second connector housing (20) within the recess section (11), and latch members (40, 50) on the cam member (30) and the first connector housing (10) for latching the cam member (30) at the closed position, the connector housing assembly being characterized in that the latch members comprise a resilient member (40) having a protrusion (42) thereon mounted on the first connector housing (10) or the cam member (30) and a plate section (50) having an aperture (54) mounted on the first connector housing (10) or the cam member 30) whereby the protrusion (42) is disposed in the aperture (54) when the cam member (30) has moved to the closed position thereby latching the connector housings together and indicating the connector housings are completely connected.

2. An electrical connector sousing assembly as claimed in claim 1, wherein the resilient member (40) is mounted on an end wall (33) of said cam member (30) and centrally thereof.

3. An electrical connector housing assembly as claimed in claim 1, wherein the resilient member (40B) is mounted an end wall (33) of said cam member (30) toward a rear side thereof.

4. An electrical connector housing assembly as claimed in claims 1–3, wherein surfaces of the resilient member (40) and the plate section (50) audibly engage each other when the protrusion (42) is received in the aperture (54).

5. An electrical connector housing assembly as claimed in claim 1, wherein the protrusion (42) is on an upper surface of said resilient member (40).

6. An electrical connector housing assembly as claimed in claim 1, where in the protrusion (42) is on a bottom surface of said resilient member (40).

7. An electrical connector housing assembly as claimed in claim 1, wherein said plate section (50) is part of said first connector housing (10) and includes a front wall (51), a back wall (52) and a joining wall (53).

* * * * *